United States Patent [19]

Otobe et al.

[11] Patent Number: 4,617,901

[45] Date of Patent: Oct. 21, 1986

[54] AIR-FUEL RATIO FEEDBACK CONTROL METHOD FOR INTERNAL COMBUSTION ENGINES

[75] Inventors: Yutaka Otobe; Akihiro Yamato, both of Shiki, Japan

[73] Assignee: Honda Giken Kogyo K.K., Tokyo, Japan

[21] Appl. No.: 684,495

[22] Filed: Dec. 21, 1984

[30] Foreign Application Priority Data

Dec. 23, 1983 [JP] Japan ..... 58-243491

[51] Int. Cl.[4] ..... F02M 51/00

[52] U.S. Cl. ..... 123/489; 123/440

[58] Field of Search ..... 123/440, 489, 571, 589

[56] References Cited

U.S. PATENT DOCUMENTS

| | | | |
|---|---|---|---|
| 4,488,529 | 12/1984 | Nishida et al. | 123/489 X |
| 4,498,445 | 2/1985 | Hasegawa et al. | 123/489 |
| 4,517,948 | 5/1985 | Kaji et al. | 123/489 |
| 4,526,001 | 7/1985 | Burns et al. | 123/489 X |

*Primary Examiner*—Willis R. Wolfe, Jr.

*Attorney, Agent, or Firm*—Arthur L. Lessler

[57] ABSTRACT

A method of controlling the air-fuel ratio of an air-fuel mixture being supplied to an internal combustion engine includes comparing the value of a signal indicative of the concentration of an exhaust gas ingredient with a predetermined reference value, detecting from the comparison result a first change in the air-fuel ratio of the mixture supplied to the engine from a value richer than a predetermined value to a value leaner than same, or a second change in the air-fuel ratio of the mixture from a value leaner than the predetermined value to a value richer than same, correcting the value of an air-fuel ratio control signal by increasing or decreasing same by a first predetermined correction value in response to the first change or the second change thus detected, and controlling the air-fuel ratio of the mixture in a feedback manner responsive to the value of the air-fuel ratio control signal thus corrected. A second predetermined correction value, in lieu of the first predetermined correction value, is applied to correction of the air-fuel ratio control signal in response to a selected one of the first change and the second change with a cycle a predetermined number of times as large as the fluctuation cycle of the exhaust gas ingredient concentration-indicative signal.

9 Claims, 10 Drawing Figures

5
ECU
CPU
22
ROM
34
RAM
36
DRIVING CIRCUIT
38
FUEL INJECTION VALVES
6
A/D
32
MULTI-PLEXER
30
LEVEL SHIFTER UNIT
28
Me VALUE COUNTER
24
WAVEFORM SHAPER
20
θth SENSOR
4
PBA SENSOR
8
Tw SENSOR
10
O2 SENSOR
15
RPM SENSOR
11

| FIG. 4A | FIG. 4B |
|---|---|

START
101
IS O2 SENSOR ACTIVATED ?
No
Yes
103
IS ENGINE IN OPEN LOOP CONTROL REGION ?
Yes
No
OPEN LOOP CONTROL
104
HAS O2 SENSOR OUTPUT BEEN INVERTED ?
No
TO 113
Yes
105
IS O2 SENSOR OUTPUT LOW ?
No
Yes
111
READ P FROM Ne-P TABLE
112
SUBTRACT P FROM Ko2
106
READ tPR FROM Ne-tPR TABLE
107
HAS tPR ELAPSED ?
No
Yes
108
READ PR FROM Ne-PR TABLE
109
READ P FROM Ne-P TABLE
FEEDBACK CONTROL
102
Ko2=1
110
ADD Pi TO Ko2
FROM 116, 118, 121, 123
END

AIR-FUEL RATIO FEEDBACK CONTROL METHOD FOR INTERNAL COMBUSTION ENGINES

BACKGROUND OF THE INVENTION

This invention relates to an air-fuel ratio feedback control method for an internal combustion engine, and more particularly to a method of this kind which is intended to enhance the exhaust gas purifying efficiency of an exhaust gas purifying device, to thereby improve the emission characteristics of the engine.

To improve the emission characteristics of an internal combustion engine, an exhaust gas purifying device is generally provided in the engine to decrease the amounts of noxious ingredients emitted from the engine. For instance, a three-way catalyst is employed as the exhaust gas purifying device, and the air-fuel ratio of a mixture being supplied to the engine is controlled, e.g. to a theoretical air-fuel ratio, in a feedback manner responsive to an air-fuel ratio control signal which has its value varied in response to the output value of an exhaust gas ingredient concentration detecting means arranged in the exhaust system of the engine, so as to promote the action of the three-way catalyst of purifying the ingredients of CO, HC and NOx in the exhaust gases at the same time. In order to control the air-fuel ratio in this manner, for instance, comparison is made between a value of the exhaust gas ingredient concentration detected by an exhaust gas ingredient concentration sensor and a predetermined reference value to determine whether there occurs a change in the air-fuel ratio of the mixture from a value richer than a theoretical mixture ratio to a value leaner than same or vice versa. Each time such change occurs, a predetermined correction value is applied to increase or decrease the value of an air-fuel ratio control signal in response to the direction of the change. The air-fuel ratio is controlled in a feedback manner responsive to the value of the air-fuel ratio control signal thus corrected.

On the other hand, the three-way catalyst has increased efficiency of purifying CO and HC when the air-fuel ratio of the mixture is leaner than the theoretical mixture ratio, while it has increased efficiency of purifying NOx when the air-fuel ratio is richer than the theoretical mixture ratio. Further, the air-fuel ratio value at which the catalyst device can exhibit the best purifying efficiency depends upon the type of the catalyst device. Therefore, to obtain the best efficiency of the catalyst device, the air-fuel ratio of the mixture has to be controlled to a predetermined value dependent upon the kind of a noxious ingredient to be purified and the type of the catalyst device employed.

SUMMARY OF THE INVENTION

It is the object of the invention to provide an air-fuel ratio feedback control method for an internal combustion engine, which can control the air fuel ratio of the mixture to a predetermined value dependent upon the kind of a noxious ingredient to be purified from the exhaust gases and the type of an exhaust gas purifying device employed, to thereby enhance the efficiency of the exhaust gas purifying device for improvement of the emission characteristics of the engine.

The present invention provides a method of controlling the air-fuel ratio of an air-fuel mixture being supplied to an internal combustion engine equipped with an exhaust system, and ingredient concentration detecting means arranged in the exhaust system for detecting the concentration of an ingredient contained in exhaust gases from the engine to produce a normally fluctuating output signal indicative of the exhaust gas ingredient concentration. The method includes comparing the value of the output signal from the ingredient concentration detecting means with a predetermined reference value, detecting from the result of the comparison a first change in the air-fuel ratio of the mixture supplied to the engine from a value richer than a predetermined value to a value leaner than the predetermined value, or a second change in the air-fuel ratio of the mixture from a value leaner than the predetermined value to a value richer than the predetermined value, correcting the value of an air-fuel ratio control signal by increasing or decreasing same by a first predetermined correction value in response to the first change or the second change thus detected, and controlling the air-fuel ratio of the mixture in a feedback manner responsive to the value of the air-fuel ratio control signal thus corrected. The method is characterized by comprising the following steps: (a) applying a second predetermined correction value, in lieu of the first predetermined correction value, to correction of the air-fuel ratio control signal in response to a selected one of the first change and the second change with a cycle a predetermined number of times as large as the fluctuation cycle of the output signal; and (b) controlling the air-fuel ratio of the air-fuel mixture by the use of the value of the air-fuel ratio control signal thus corrected.

Preferably, the method according to the invention includes the step of detecting whether or not a predetermined period of time has elapsed after the selected one of the first and second changes was detected by which the second predetermined correction value was applied to the correction of the air-fuel ratio control signal, and wherein the second predetermined correction value is applied to the correction of the air-fuel ratio control signal, when the selected one of the first and second changes is again detected immediately after the lapse of the predetermined period of time.

Still preferably, the predetermined period of time is set to values dependent upon operating conditions of the engine, e.g. the rotational speed of the engine, and a rate of change in the rotational speed of the engine.

Further preferably, the value of the air-fuel ratio control signal is increased or decreased by a third predetermined correction value in synchronism with generation of a predetermined control signal, so long as the air-fuel ratio of the air-fuel mixture supplied to the engine maintains a value richer than the predetermined value or a value leaner than the predetermined value.

The above and other objects, features and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
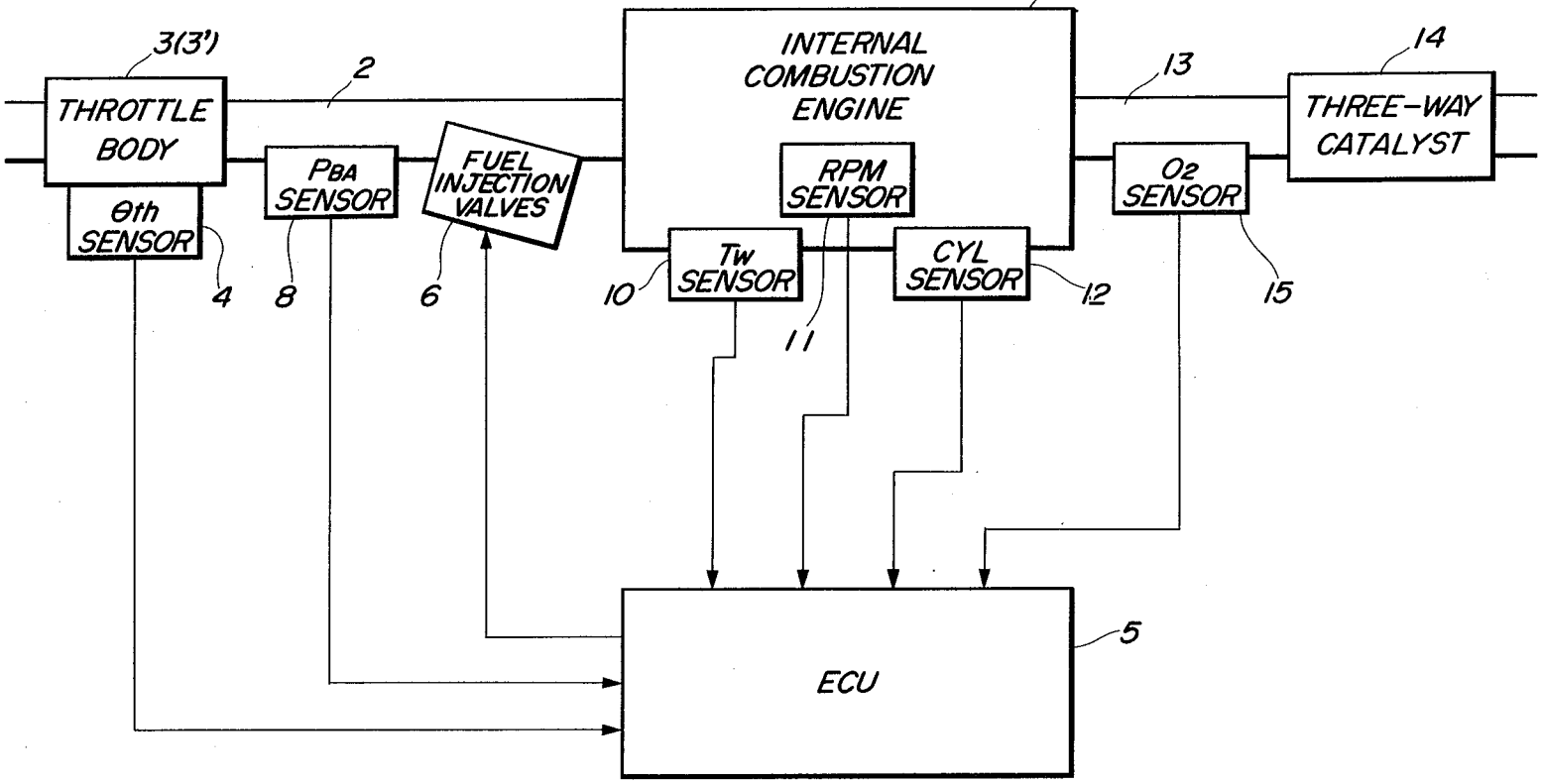
FIG. 1 is a block diagram illustrating the whole arrangement of a fuel supply control system to which is applicable the method according to the invention.

Referring first to FIG. 1, there is illustrated the whole arrangement of an air-fuel ratio control system for internal combustion engines, to which the method of the invention is applied. Reference numeral 1 designates an internal combustion engine of a four-cylinder type, for instance, to which is connected an intake pipe 2. A throttle body 3 is arranged in the intake pipe 2 and accommodates therein a throttle valve 3' to which a throttle valve opening ($\theta$TH) sensor 4 is coupled for detecting its valve opening and converting same into an electrical signal which is supplied to an electronic control unit (hereinafter called "the ECU") 5.

Fuel injection valves 6 as a fuel metering device are arranged in the intake pipe 2 at a location between the engine 1 and the throttle body 3, and connected to a fuel pump, not shown. These fuel injection valves 6 are also electrically connected to the ECU 5 in a manner having their valve opening periods or fuel injection quantities controlled by signals supplied from the ECU 5.

An absolute pressure (PBA) sensor 8 is arranged in the intake pipe 2 at a location downstream of the throttle valve 3' for detecting absolute pressure in the intake pipe 2 and supplying an electrical signal indicative of the detected absolute pressure to the ECU 5.

An engine temperature (TW) sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rotational angle position/RPM sensor 11 and a cylinder-discriminating (CYL) sensor 12 are arranged in facing relation to a camshaft, not shown, of the engine 1 or a crankshaft of same, not shown. The former 11 is adapted to generate one pulse at each of particular crank angles of the engine each time the engine crankshaft rotates through 180 degrees, i.e. upon generation of each pulse of a top-dead-center position (TDC) signal, while the latter 12 is adapted to generate one pulse at a particular crank angle of a particular engine cylinder. The pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a difference between the detected concentration value and a predetermined reference value Vr to the ECU 5.

The ECU 5 operates in response to the various engine operation parameter signals stated above, to calculate the fuel injection period TOUT for which the fuel injection valves 6 should be opened, in synchronism with generation of pulses of the TDC signal, by using the following equation:

$$TOUT = Ti \times K1 \times KO_2 + K2$$

where Ti represents a basic value of the valve opening period or fuel injection period of the fuel injection valves 6, which is read from a memory in the ECU 5 as a function of the engine speed Ne and the intake pipe absolule pressure PBA. $KO_2$ represents an $O_2$ sensor output-dependent correction coefficient, hereinafter referred to, with which the present invention is concerned. K1 and K2 represent correction coefficients and correction variables, respectively, which are calculated on the basis of values of the aforementioned various engine operation parameter signals to such values as to optimize various operating characteristics of the engine such as fuel consumption and accelerability.

The ECU 5 operates on the value of the fuel injection period TOUT determined as above to supply corresponding driving signals to the fuel injection valves 6.

Figure 2:
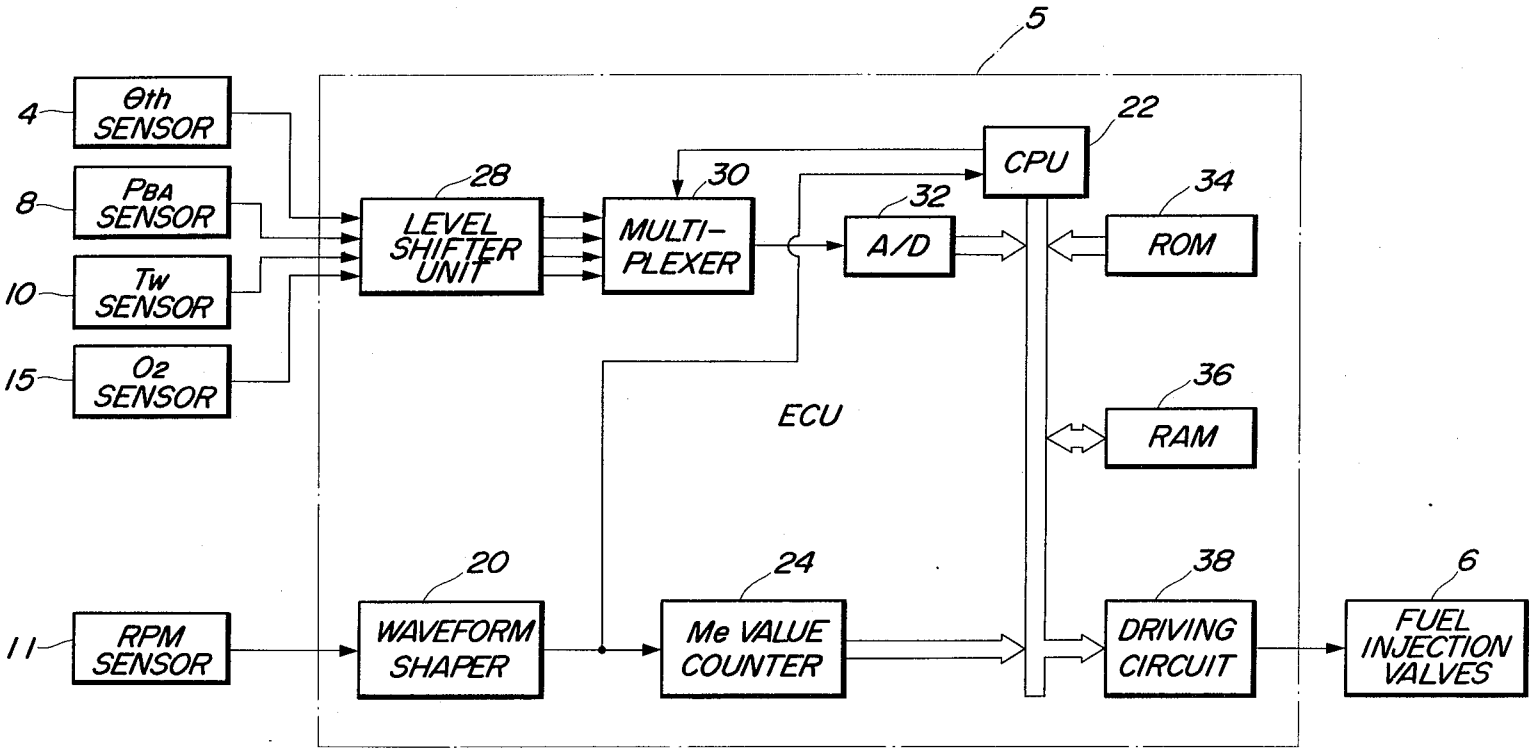
FIG. 2 is a block diagram illustrating the internal arrangement of an electronic control unit (ECU) appearing in FIG. 1.

FIG. 2 shows a circuit configuration within the ECU 5 appearing in FIG. 1. An output signal from the engine rotational angle position/RPM sensor 11 is applied to a waveform shaper 20, wherein it has its pulse waveform shaped, and supplied to a central processing unit (hereinafter called "the CPU") 22, as the TDC signal, as well as to an engine rotational speed counter (hereinafter called "the Me value counter") 24. The Me value counter 24 counts the interval of time between generation of a preceding pulse of the TDC signal and generation of a present pulse of the same signal inputted thereto from the engine rotational angle position/RPM sensor 11, and therefore its counted value Me is proportional to the reciprocal of the actual engine speed Ne. The Me value counter 24 supplies the counted value Me to the CPU 22 via a data bus 26.

The respective output signals from the throttle valve opening ($\theta$TH) sensor 4, the intake pipe absolute pressure (PBA) sensor 8, the engine cooling water temperature (TW) sensor 10, and the $O_2$ sensor 15 are applied to a level shifter unit 28, wherein they have their voltage levels shifted to a predetermined voltage level, and then successively supplied to an analog-to-digital converter 32 through a multiplexer 30 operable in accordance with a command from the CPU 22. The anolog-to-digital converter 32 successively converts anlog output voltages from the aforementioned various sensors into respective corresponding digital signals, and the resulting digital signals are supplied to the CPU 22 via the data bus 26.

Further connected to the CPU 22 via the data bus 26 are a read-only memory (hereinafter called "the ROM") 34, a random access memory (hereinafter called "the RAM") 36, and a driving circuit 38. The ROM 34 stores a control program executed within the CPU 22 and various data such as correction coefficient values, while the RAM 36 temporarily stores various calculated values from the CPU 22.

The CPU 22 executes the control program stored in the ROM 34 to read from the ROM 34 values of the correction coefficients and correction variables dependent upon the output values of the various sensors, and to calculate the fuel injection period TOUT for the fuel injection valves 6 by using the aforementioned equation, and supplies the calculated value of the fuel injection period TOUT to the driving circuit 38 through the data bus 26. The driving circuit 38 supplies driving signals to the fuel injection valves 6, to open same for a period of time corresponding to the calculated fuel injection period value TOUT.

Figure 3:
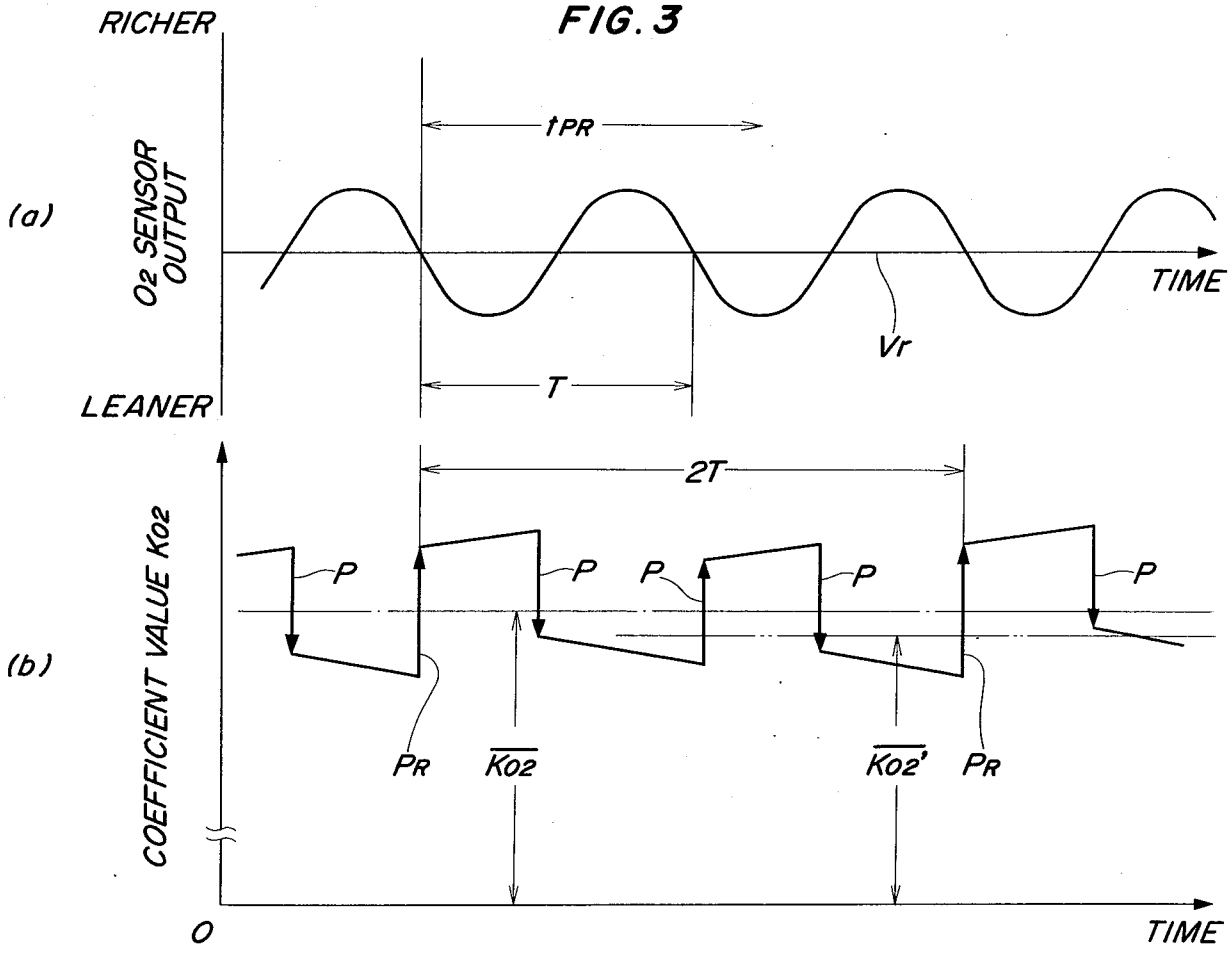
FIG. 3 is a timing chart showing changes in the values of an output voltage of an $O_2$ sensor and an $O_2$ sensor output-dependent correction coefficient $KO_2$ relative to the lapse of time, useful for explanation of a manner of setting the same correction coefficient value $KO_2$.

FIG. 3 shows a manner of controlling the air-fuel ratio of an air-fuel mixture being supplied to the engine, according to one embodiment of the invention. As shown in (a) of FIG. 3, the output of the $O_2$ sensor 15 fluctuates during operation of the engine, and its fluctuation cycle T varies in dependence on the engine speed Ne, that is, becomes higher as the engine speed Ne increases. The $O_2$ sensor 15 is adapted to generate a RICH signal indicative of an air-fuel ratio richer than a theoretical mixture ratio when the detected value of the oxygen concentration is larger than the reference value Vr, and generate a LEAN signal indicative of an air-fuel ratio leaner than the theoretical mixture ratio when the detected concentration value is smaller than the reference value Vr.

According to the present embodiment, the air-fuel mixture has its air-fuel ratio controlled to a predetermined value smaller or richer than a theoretical mixture ratio, so as to reduce the amount of nitrogen oxides NOx to be emitted from the engine 1 equipped with the three-way catalyst 14 as shown in FIG. 1. To this end, when the output of the $O_2$ sensor 15 changes from the RICH signal to the LEAN signal, a predetermined correction value PR is applied to correction of the value of the $O_2$ sensor output-dependent correction coefficient $KO_2$ with a cycle twice the output fluctuation cycle T of the $O_2$ sensor 15, as shown in (b) of FIG. 3. When the predetermined correction value PR is not applied, another predetermined correction value P which is smaller than the correction value PR is added to or subtracted from the correction coefficient value $KO_2$, respectively, to increase or decrease the same coefficient value $KO_2$, each time the $O_2$ sensor 15 has its output shifted from the RICH signal to the LEAN signal or vice versa. On the other hand, while no change takes place in the output of the $O_2$ sensor 15 from the RICH signal to the LEAN signal or vice versa, integral term control, hereinafter referred to, is carried out to gradually increase or decrease the correction coefficient value $KO_2$ so as to obtain a desired value of the coefficient $KO_2$. Consequently, a mean value $\overline{KO_2}$ of the correction coefficient $\overline{KO_2}$ obtained according to the present invention will be larger than a mean value $K0_2'$ of the same coefficient obtained by a conventional method wherein the predetermined value P alone is employed for correction of the coefficient $KO_2$. Therefore, by applying the thus corrected coefficient value $KO_2$ as an air-fuel ratio feedback control signal, the air-fuel ratio of the mixture can be controlled to a value smaller than a theoretical mixture ratio, due to the increased correction coefficient mean value $\overline{KO_2}$. Besides, any desired value of the air-fuel ratio of the mixture can be obtained by appropriately setting the correction values PR, P and/or the cycle with which the correction value PR is applied.

Figures 4, 4B:
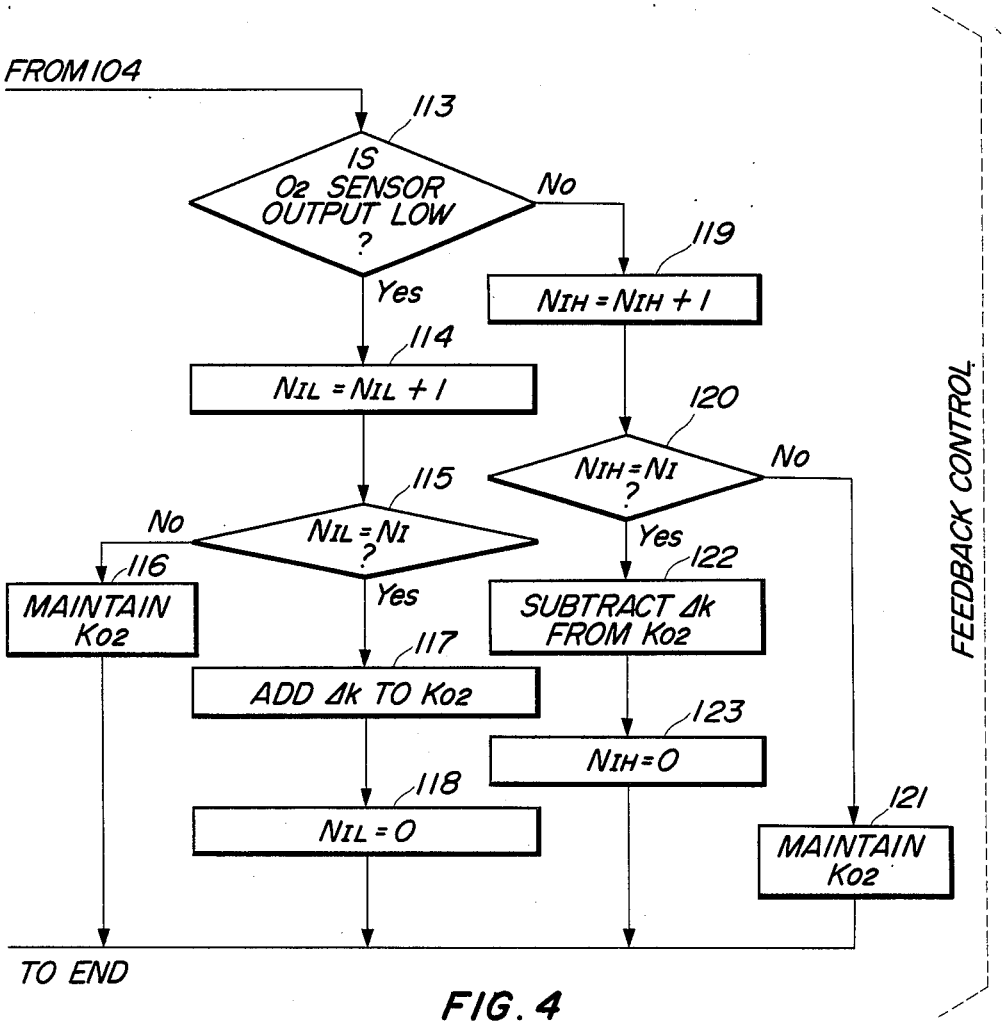
FIG. 4, 4A and 4B are flowcharts of a manner of calculating the value of the correction coefficient $KO_2$.
Figure 4A:
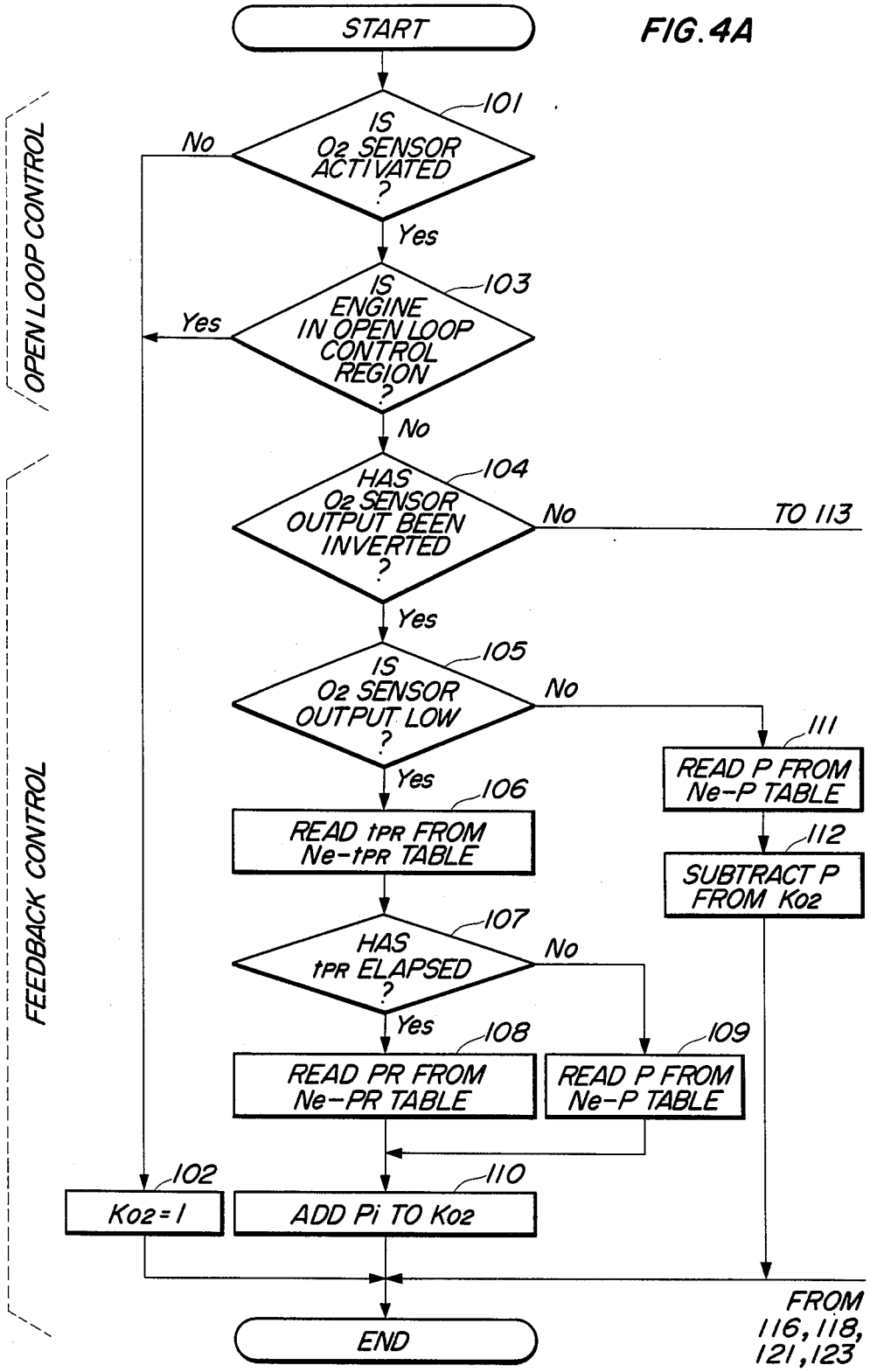

FIGS. 4A and 4B show a flowchart of a subroutine for calculating the value of the $O_2$ sensor output-dependent correction coefficient $KO_2$, according to the example of FIG. 3.

First, at the step 101, a determination is made as to whether or not the $O_2$ sensor 15 has completed its activation. The activation of the $O_2$ sensor may be determined by sensing the internal resistance of the same sensor, that is, by determining whether or not the output voltage of the $O_2$ sensor has dropped below a predetermined value Vx, e.g. 0.6 volts, after the ignition switch, not shown, of the engine is turned on. When the output voltage of the $O_2$ sensor drops below the predetermined value Vx, it is judged that the $O_2$ sensor 15 is activated. If the answer to the question at the step 101 is no, the value of the correction coefficient $KO_2$ is set to 1 at the step 1O2, while if the answer is yes, it is determined whether or not the engine is operating in an open loop mode control region such as a wide-open-throttle region, at the step 103. If the determination at the step 103 provides an affirmative answer, the step 102 is executed to set the coefficient value $KO_2$ to 1, while simultaneously setting the correction coefficients K1, K2 to respective appropriate values dependent upon an operating condition in which the engine is operating, to thereby control the air-fuel ratio of the mixture in open loop mode by the use of the coefficient values K1, K2 thus set, as conventionally known.

Figure 5:
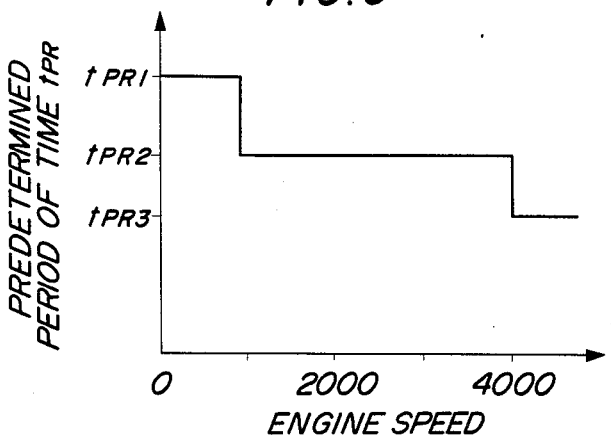
FIG. 5 is a graph showing, by way of example, a table of the relationship between a predetermined period of time tPR and the engine speed Ne.

On the other hand, if the answer to the question at the step 103 is no, the air-fuel ratio of the mixture is controlled in closed loop mode, followed by a determination as to whether or not the output of the $O_2$ sensor 15 has been inverted, at the step 104. If the answer to the question at the step 104 is yes, proportional term control (P-term control) of the correction coefficient $KO_2$ is carried out. That is, it is first determined at the step 105 whether or not the output of the $O_2$ sensor 15 has a low level (i.e. the LEAN signal). If the answer is yes, the program proceeds to the step 106 to read a value of a predetermined period of time tPR (FIG. 3), which corresponds to the engine speed Ne, from an Ne-tPR table stored in the ROM 34 in FIG. 2. The predetermined period of time tPR is used as a parameter for applying the second predetermined value PR to correction of the coefficient value $KO_2$ with a cycle a predetermined number of times as large as the output fluctuation cycle T of the $O_2$ sensor 15. According to the present embodiment of the invention, the period of time tPR is set to such a value that enables the correction value PR to be applied to correction of the coefficient value $KO_2$ with a cycle twice as large as the output fluctuation cycle T of the $O_2$ sensor 15, for instance, it may be set to 1.25 times as large as the output fluctuation cycle T of the $O_2$ sensor 15. Since the fluctuation cycle T becomes shorter with an increase in the engine speed Ne, the period of time tPR has its value set to smaller values as the engine speed Ne increases as shown in FIG. 5, so that the cycle of application of the correction value PR remains constant (=2T) over the whole engine speed region. For instance, the period of time tPR is set to a value tPR1 when the engine speed Ne is lower than 1000 rpm, to a value tPR2 (<tPR1) when the engine speed Ne falls within a range between 1000 rpm and 4000 rpm, and to a value tPR3 (<tPR2) when the engine speed Ne exceeds 4000 rpm, respectively, as shown in FIG. 5.

Figure 6:
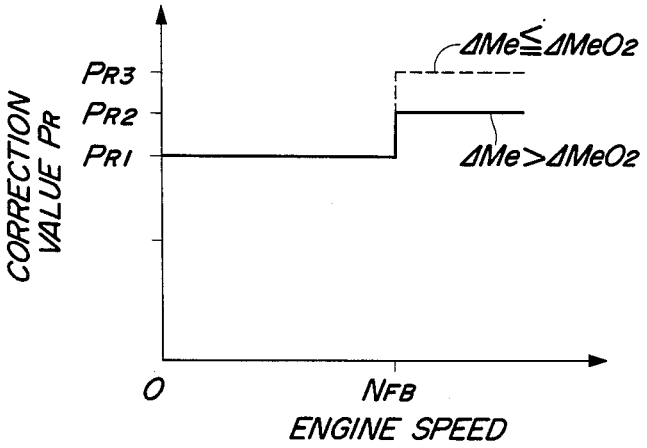
FIG. 6 is a graph showing, by way of example, a table of the relationship between a correction value PR and the engine speed Ne.

Following the step 106 in FIG. 4, the step 107 is executed to determine whether or not the period of time tPR has elapsed since the second correction value PR was applied last. If the answer is yes, a correction value PR is read from an Ne-PR table stored in the ROM 34, which corresponds to the engine speed Ne and a differential value ΔMe, to be applied to correction of the coefficient value $KO_2$, at the step 108. The differential value ΔMe is the difference between the count value Men counted by the Me value counter 24 in the present loop and the count value Men-1 counted by the same counter in the immediately preceding loop (i.e. ΔMe=-Men−Men−1), and represents the rate of acceleration of the engine. That is, when the difference ΔMe assumes a negative value, the smaller the differential value ΔMe, the larger the rate of acceleration of the engine is. For instance, as shown in FIG. 6, the correction value PR is set to a value PR1 when the engine speed Ne is lower than a predetermined speed NFB (e.g. 1000 rpm), to a value PR2 (>PR1) when the engine speed Ne is higher than the predetermined speed NFB and at the same time the difference ΔMe assumes a value larger than a predetermined negative value $\Delta MeO_2$, and to a value PR3 (>PR2) when the engine speed Ne is higher than the predetermined speed NFB and at the same time the difference ΔMe assumes a value smaller than or equal to the predetermined negative value $\Delta MeO_2$, wherein the engine is accelerating, respectively. The correction value PR thus set to larger values at high speed and acceleration of the engine serve to enhance the responsiveness to changes in the engine speed or engine speed change rate in performing the air-fuel ratio feedback control.

Figure 7:
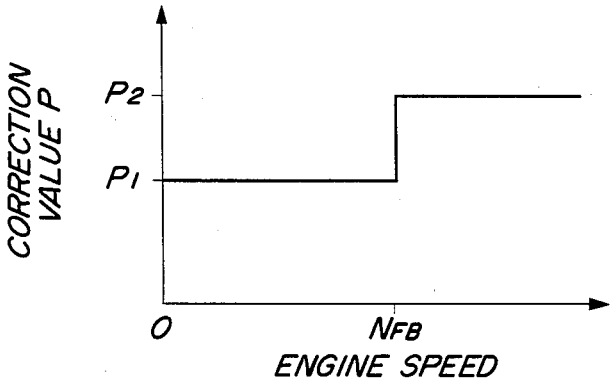
FIG. 7 is a graph showing, by way of example, a table of the relationship between a correction value P and the engine speed Ne.

If the answer to the question of the step 107 in FIG. 4 is no, that is, when it is determined that the period of time tPR has not elapsed since the correction value PR was applied last, the step 109 is executed to read a correction value P corresponding to the engine speed Ne from an Ne-P table stored in the ROM 34. As shown in FIG. 7, the correction value P is set to a value P1 when the engine speed Ne is lower than the predetermined speed NFB, and to a value P2 (>P1) when the engine speed Ne is higher than the predetermined speed NFB, thereby enhancing the responsiveness of air-fuel ratio feedback control during high speed operation of the engine. As distinct from the correction value PR, the correction value P is employed not to bias the mean value of the $O_2$ sensor output-dependent correction coefficient $KO_2$ toward a larger side, but to carry out normal proportional term control of the same coefficient. It is therefore set to a value different from the correction value PR, preferably to a value smaller than the correction value PR.

Then, the step 110 is executed, wherein when the execution of the present step 110 follows the execution of the step 108, the second correction value PR is employed as a correction value Pi, while when the step 110 follows the step 109, the first correction value P is employed as the correction value Pi, and the correction value Pi thus set is added to a coefficient value $KO_2$ calculated in the immediately preceding loop, to employ the resulting value as a coefficient value $KO_2$ to be applied in the present loop.

If the answer to the question of the step 105 is no, the program proceeds to the step 111 to read a correction value P corresponding to the engine speed Ne from the Ne-P table, and the correction value P thus read is subtracted from the coefficient value $KO_2$ calculated in the immediately preceding loop, to employ the resulting value as a coefficient value $KO_2$ to be applied in the present loop, at the step 112.

If the answer to the question of the step 104 is no, that is, when there has been no inversion in the output level of the $O_2$ sensor 15, integral term control (I-term control) of the correction coefficient value $KO_2$ is carried out. That is, it is first determined whether or not the output of the $O_2$ sensor 15 has a low level, at the step 113. If the answer is yes, 1 is added to a count value NIL to count the number of pulses of the TDC signal at the step 114, and then a determination is made at the step 115 as to whether or not the count value NIL is equal to a predetermined value NI, 30 pulses for instance. When the count value NIL has not reached the predetermined value NI, the coefficient value $KO_2$ is maintained at a value obtained in the immediately preceding loop at the step 116. On the other hand, when the count value NIL has reached the predetermined value NI, a predetermined value Δk (e.g. a value equal to approximately 0.3% of the coefficient value $KO_2$) is added to the coefficient value $KO_2$ calculated in the immediately preceding loop at the step 117, and at the same time the count value NIL is reset to zero at the step 118. In this manner, the predetermined value Δk is added to the coefficient value $KO_2$ each time the count value NIL reaches the predetermined value NI. When the determination at the step 113 provides a negative answer (no), 1 is added to a count value NIH to count the number of TDC signal pulses at the step 119, and it is then determined whether or not the count value NIH is equal to the predetermined value NI at the step 120. If the answer is no, the correction coefficient value $KO_2$ is maintained at a value obtained in the immediately preceding loop at the step 121. If the answer is yes, the predetermined value Δk is subtracted from the coefficient value $KO_2$ calculated in the immediately preceding loop (step 122), and simultaneously the count value NIH is reset to zero (step 123). In this manner, the predetermined value Δk subtracted from the coefficient value $KO_2$ each time the count value NIH reaches the predetermined value NI.

Figure 8:
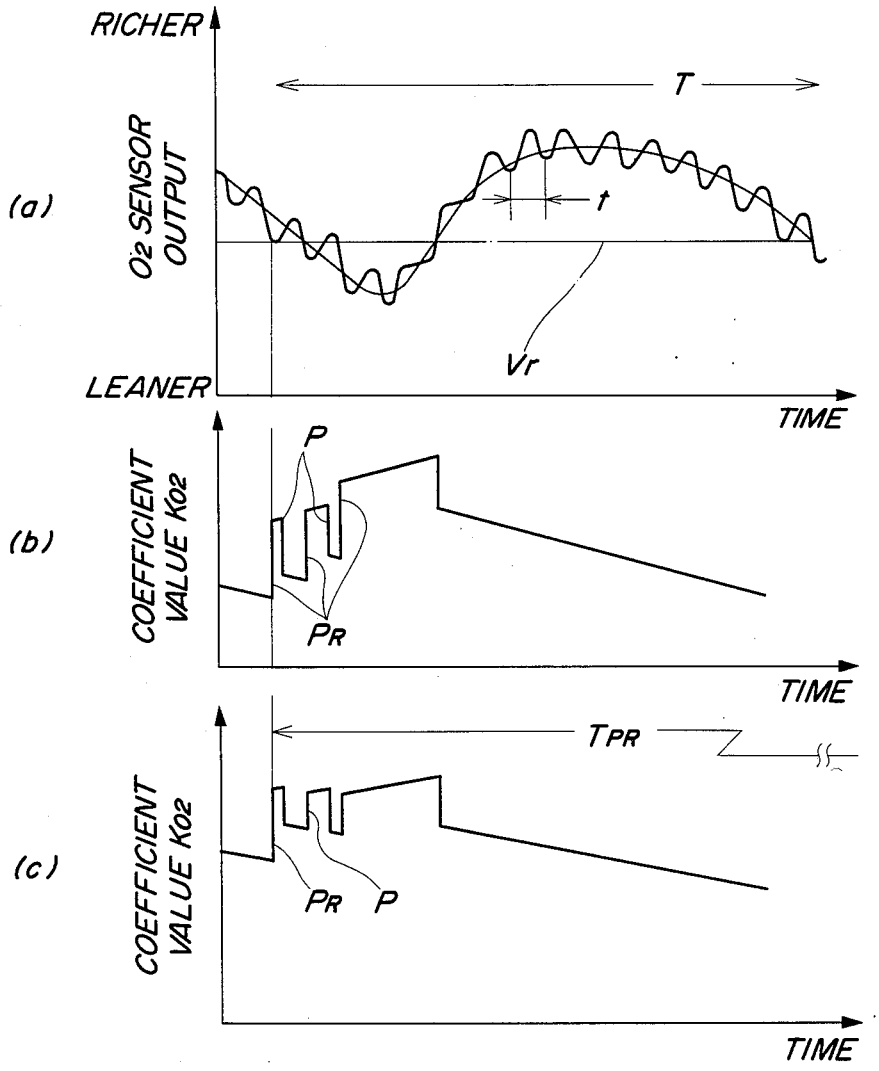
FIG. 8 is a timing chart showing changes in the value of the correction coefficient $KO_2$ relative to the lapse of time, when a high-frequency fluctuation takes place in the varying output voltage of the $O_2$ sensor.

According to the method of the invention described above, the air-fuel ratio of the mixture can be adjusted by means of the correction value PR as well as the predetermined period of time tPR, making it possible to control the air-fuel ratio with accuracy and providing a further advantageous effect as follows: The output value of the $O_2$ sensor 15 can contain a high-frequency fluctuation factor due to variations in the air-fuel ratio of the mixture supplied to the engine cylinders, etc., as shown in (a) of FIG. 8. Therefore, if the step 107 in FIG. 4 is not provided and accordingly the second correction value PR is applied to correction of the coefficient value $KO_2$ each time the output of the $O_2$ sensor 15 shifts from the RICH signal to the LEAN signal, the coefficient value $KO_2$ can vary in a manner shown in (b) of FIG. 8 when the output value of the $O_2$ sensor 15 falls within a region close to the reference value Vr, since in such region the $O_2$ sensor 15 alternately generates the RICH signal and the LEAN signal within a short period of time due to the high-frequency fluctuation factor, thus resulting in an excessive increase of the coefficient value $KO_2$ and consequently an erroneous air-fuel ratio obtained. According to the invention, however, once the correction value PR is applied, the other correction value P is applied to increase or decrease the coefficient value $KO_2$ each time the output of the $O_2$ sensor is inverted, for the predetermined period of time tPR larger than the output fluctuation cycle T of the $O_2$ sensor 15, thereby preventing error in the air-fuel ratio control.

Although in the embodiment described above, the air-fuel ratio of the mixture is controlled to a predetermined value smaller than a theoretical mixture ratio, it may alternatively be controlled to a value leaner than the theoretical mixture ratio so as to reduce the amounts of unburnt hydrocarbon and carbon monoxide emitted from the engine. To realize this, when the output of the $O_2$ sensor 15 shifts from the LEAN signal to the RICH signal, the second correction value PR may be subtracted from the correction coefficient value $KO_2$ with a cycle a predetermined number of times as large as the output fluctuation cycle T of the $O_2$ sensor, whereas while the correction value PR is not applied and at the same time the output of the $O_2$ sensor shifts from the LEAN signal to the RICH signal or vice versa, the correction value P may be employed to increase or decrease the coefficient value $KO_2$, to thereby obtain a desired coefficient value $KO_2$ for applying to the air-fuel ratio control.

What is claimed is:

1. A method of controlling the air-fuel ratio of an air-fuel mixture being supplied to an internal combustion engine equipped with an exhaust system in a feedback manner responsive to output from ingredient concentration detecting means arranged in said exhaust system for detecting the concentration of an ingredient contained in exhaust gases from said engine to produce as said output a normally fluctuating output signal indicative of the exhaust gas ingredient concentration, the method including:

comparing the value of said output signal from said ingredient concentration detecting means with a predetermined reference value, detecting from the result of said comparison a first change in the air-fuel ratio of said mixture supplied to said engine from a value richer than a predetermined value to a value leaner than said predetermined value, and a second change in the air-fuel ratio of said mixture from a value leaner than said predetermined value to a value richer than said predetermined value, correcting the value of an air-fuel ratio control signal by varying said air-fuel ratio control signal value by a first predetermined correction value in response to a detected one of said first and second changes, and controlling the air-fuel ratio of said mixture in response to the value of said air-fuel ratio control signal thus corrected, to thereby effect said feedback control of the air-fuel ratio, the method comprising the step of:

(a) applying a second predetermined correction value which is different from the first predetermined correction value, in lieu of said first predetermined correction value, to said correction of said air-fuel ratio control signal in response to a selected one of said first and second changes, with a cycle a predetermined number of times as large as the fluctuation cycle of said output signal; and (b) controlling the air-fuel ratio of said air-fuel mixture by the use of the value of said air-fuel ratio control signal thus corrected, to thereby effect said feedback control.

2. A method as claimed in claim 1, wherein the value of said air-fuel ratio control signal is increased or decreased by a third predetermined correction value in synchronism with generation of a predetermined control signal, so long as the air-fuel ratio of said air-fuel mixture supplied to said engine maintains a value richer than said predetermined value or a value leaner than said predetermined value.

3. A method as claimed in claim i, wherein said second predetermined correction value is larger than said first predetermined correction value.

4. A method as claimed in claim 1, wherein said second predetermined correction value is smaller than said first predetermined correction value.

5. A method as claimed in claim 1, including the step of detecting whether or not a predetermined period of time has elapsed after said selected one of said first and second changes was detected by which said second predetermined correction value was applied to said correction of said air-fuel ratio control signal, and wherein said second predetermined correction value is applied to said correction of the air-fuel ratio control signal, when said selected one of said first and second changes is again detected immediately after the lapse of said predetermined period of time.

6. A method as claimed in claim 5, wherein said predetermined period of time is set to a value intermediate between a value smaller than said cycle said predetermined number of times as large as the fluctuation cycle of the value of said output signal by one fluctuation cycle of same, and said cycle said predetermined number of times as large as the fluctuation cycle of the value of said output signal.

7. A method as claimed in claim 5, wherein said predetermined period of time is set to values dependent upon operating conditions of said engine.

8. A method as claimed in claim 7, wherein said predetermined period of time is set to a value corresponding to the rotational speed of said engine.

9. A method as claimed in claim 8, wherein said predetermined period of time is set to a value corresponding to a rate of change in the rotational speed of said engine.

* * * * *

UNITED STATES PATENT AND TRADEMARK OFFICE

CERTIFICATE OF CORRECTION

PATENT NO. : 4,617,901

DATED : October 21, 1986

INVENTOR(S) : Yutaka Otobe, Akihiro Yamato

It is certified that error appears in the above-identified patent and that said Letters Patent are hereby corrected as shown below:

Claim 3, Column 10, line 21: change "in claim i" to "in claim 1".

Signed and Sealed this

Twenty-fourth Day of February, 1987

*Attest:*

DONALD J. QUIGG

*Attesting Officer*

*Commissioner of Patents and Trademarks*